United States Patent [19]

Ebihara

[11] Patent Number: 4,717,062

[45] Date of Patent: Jan. 5, 1988

[54] STAPLER

[76] Inventor: Yoshiyuki Ebihara, 22-7, Igusa 3-chome, Suginami-ku, Tokyo, Japan

[21] Appl. No.: 856,598

[22] Filed: Apr. 25, 1986

[30] Foreign Application Priority Data

Sep. 20, 1985 [JP] Japan ..... 60-207839

[51] Int. Cl.[4] ..... B25C 5/02

[52] U.S. Cl. ..... 227/120; 227/156

[58] Field of Search ..... 227/120, 156

[56] References Cited

U.S. PATENT DOCUMENTS 3,640,443 2/1972 Itagaki ..... 227/120

3,665,580 5/1972 Mashita ..... 227/120

*Primary Examiner*—E. R. Kazenske

*Assistant Examiner*—James L. Wolfe

*Attorney, Agent, or Firm*—Abelman Frayne Rezac & Schab

[57] ABSTRACT

The present invention provides a staple including a base, a hollow frame pivotably mounted on the base and having a forward closed end and a rearward opened end, a handle pivotably mounted on the frame and a feeder mounted in the hollow portion of the frame, the feeder including a cap mounted on the rearward opened end of the frame, a rod extending inwardly from the inner face of the cap, a feeder element slidably mounted on the inner end of the rod and adapted to engage the rearmost one of staples housed in the hollow portion of the frame and a coil spring mounted about the rod and resiliently acting between the feeder element and the inner face of the cap to urge the staples toward the forward closed end of the frame.

1 Claim, 3 Drawing Figures

STAPLER

BACKGROUND OF THE INVENTION

1. Field of the Invention

The present invention relates to improvements of a stapler.

2. Description of the Prior Art

There is known a stapler of such a type that a set of staples are charged into a frame through the rearward opened end thereof. For example, in Japanese Utility Model Application Sho No. 59-140418, we have proposed a disposable stapler which can simply and easily be assembled. In such staplers, the set of staples charged into the stapler frame are resiliently urged toward the forward end of the frame by means of a feeder which comprises a feeder element engaging the rearmost staple in the charged staples, a cap closing the rearward opened end of the frame and a coil-shaped compression spring between the cap and the feeder element for resiliently urging the feeder element in the forward direction. The compression spring is mounted within the frame between the feeder element and the cap without being supported by any guide means. Therefore, the compression spring may be bent or twisted such that its function will not sufficiently be performed. Furthermore, the compression spring is relatively troublesomely mounted within the frame of the stapler.

SUMMARY OF THE INVENTION

It is therefore an object of the present invention to provide an improved feeder suitable for use in an stapler of such a type that a set of staples are charged into the stapler frame through the rearward opened end thereof, said improved feeder capable of being easily and simply mounted on the stapler frame and performing its function sufficiently.

To this end, the present invention provides a stapler comprising a base, a frame pivotably mounted on the base and adapted to receive a set of separatably connected staples through the rearward opened end of the frame, a feeder mounted in the frame through the rearward opened end thereof and for resiliently urging the staples in the frame toward the forward end thereof and a handle pivotably mounted at rearward end on the frame, the improvement being characterized by that said feeder comprising a feeder element engaging the rearmost staple in the charged staples, a rod on which the feeder element is slidably mounted, a cap connected with the rearward end of said rod and a coil-shaped compression spring mounted about said rod and resiliently acting between the feeder element and the cap.

DESCRIPTION OF PREFERRED EMBODIMENTS

Figure 1:
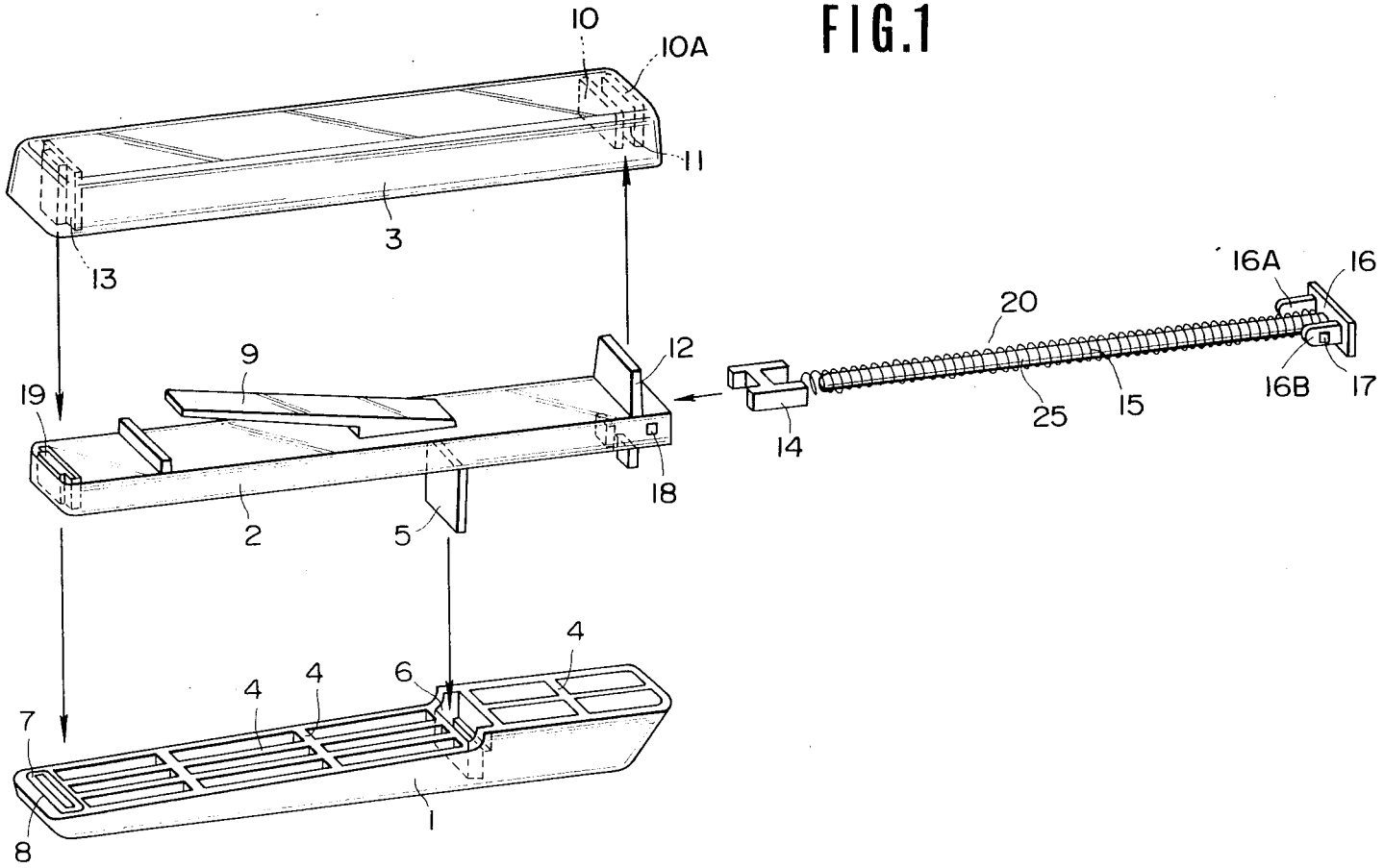
FIG. 1 is an exploded perspective view of one embodiment of a stapler constructed in accordance with the present invention.
Figure 2:
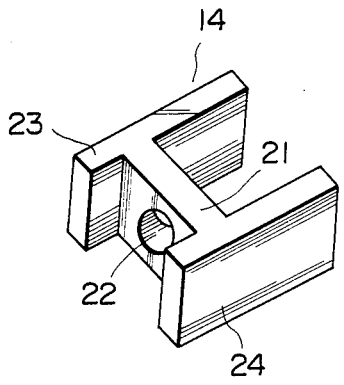
FIG. 2 is an enlarged perspective view of a feeder element used in the feeder of FIG. 1.
Figure 3:
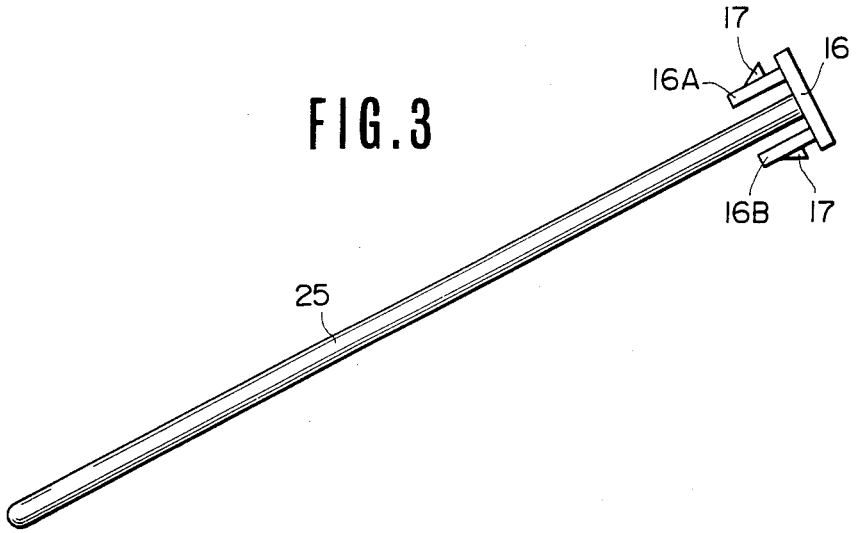
FIG. 3 is a plan view showing a cap and a rod formed integrally on the cap which are used in the feeder of FIG. 1.

Referring to FIG. 1, there is shown a stapler comprising a base 1, staple housing means (frame in the illustrated embodiment) 2 mounted on the base in such a manner as will be described, and a handle 3 mounted on the frame 2 in such a manner as will be described. The base 1 is of an elongated box configuration and includes internal reinforcing walls 4 formed therein. The forward end 8 of the base 1 includes an anvil 7 which is well-known in the art and which is mounted on the inwardly facing side thereof in a known manner. The base 1 also includes a recess 6 formed therein at a position slightly rearwardly spaced apart from the central portion between the opposite ends of the base 1, for a purpose which will be described.

The frame 2 includes a longitudinally extending hollow portion into which a set of staples are adapted to be charged. The bottom face of the frame 2 includes a flexible plate-like element 5 extending downwardly from the bottom of the frame 2 at its substantially central position. The plate-like element 5 is inserted into the recess 6 such that the frame 2 can be pivoted relative to the base 1 about the plate-like element 5. The top portion of the frame 2 corresponding to the plate-like element 5 includes a spring element 9 extending forwardly and upwardly therefrom and co-operating with the handle 3 as will be described hereinafter. The frame 2 includes another flexible plate-like element 12 extending upwardly from the top face thereof at the rearward end and which also co-operates with the handle 3 as will be described hereinafter. The frame 2 further includes slots 19 formed at the forward end through the top and bottom walls thereof as be well-known. The foremost one of the staples charged into the interior of the frame 2 is positioned between the top and bottom slots 19.

The handle 3 is of an elongated box configuration similar to that of the base 1 and includes an actuating element 13 mounted in the interior of the handle 3 at the forward end. When the forward end of the handle 3 is manually moved downwardly as be well-known, the actuating element 13 is moved through the slots 19 on the forward end of the frame 2 to drive the foremost one of the staples in the frame 2 downwardly toward the anvil 7. The driven staple is deformed into a form which is suitable to connect objects such as sheets of paper with each other.

The handle 3 also includes a rearward end gap 11 for receiving the plate-like element 12 on the rearward end of the frame 2, the rearward end gap 11 being formed by a pair of spaced plate-like elements 10, 10A which extending downwardly from the rearward end of the handle 3 therein. The plate-like element 12 of the frame 2 is received in the gap 11 such that the handle 3 can resiliently be pivoted relative to the frame and base 2, 1 about the plate-like element 12.

A set of staples charged in the hollow portion of the frame 2 are resiliently urged toward the forward end of the frame 2 by means of a feeder 20 to align the foremost one of the staples with the slots 19 of the frame 2. When the actuating element 13 of the handle 3 is moved through the slots 19, the foremost staple is separated from the staple set and then brought into engagement with the anvil 7 on the base 1, as will be apparent for a person skilled in the art.

The feeder 20 comprises a forward feeder element 14 engaging the rearmost staple of the staple set, a coil spring 15 for resiliently urging the feeder element 14 toward the forward end of the frame 2, and a cap 16 engaging the rearward end of the coil spring 15 and connected with the rearward end of the frame 2. The feeder element 14 is of an H-shaped cross-section with the central connecting portion including a small aperture 22 formed therethrough at the central position. The feeder element 14 is mounted in the frame 2 so that the opposite leg portions 23 and 24 are engaged at the ends by the rearmost staple. The small aperture 22 in the feeder element 14 slidably receives the tip of a rod 25 extending inwardly from the inner wall of the cap 16 and perpendicular thereto. The coil spring 15 is mounted about the rod 25 as shown in FIG. 1 and adapted to act resiliently between the back face of the central connecting portion 21 of the feeder element 14 and the inner face of the cap 16. When the cap 16 is mounted on the rearward end of the frame 2, the coil spring 15 resiliently urges the feeder element 14 and thus the staple set in the forward direction.

The cap 16 also includes mounting lugs 16A and 16B located on the opposite sides of the rod 25 and extending inwardly from the inner face of the cap 16 parallel to the rod 25. Each of the mounting lugs 16A and 16B includes a projection 17 extending laterally from the outer side thereof. When the cap 16 is fitted into the rearward opened end of the frame 2, the lugs 16A and 16B are resiliently deflected inwardly. When the projections 17 on the deflected lugs 16A and 16B are respectively aligned with apertures 18 (FIG. 1) which are formed the corresponding portions of the sidewalls of the frame 2, the projections 17 snappedly engage the respective apertures 18. As a result, the cap 16 can rigidly be mounted on the rearward opened end of the frame 2.

On assembling, a set of staples are first charged into the interior of the frame 2 through the rearward opened end thereof. The tip of the rod 25 on the cap 16 is inserted into the small aperture 22 of the feeder element 14 after the coil spring 15 has been mounted about the rod 25. Thereafter, the assembly of the feeder element, rod and spring (14, 25, 15) is inserted into the interior of the frame 2 through the rearward opened end thereof and then the cap 16 is pushed against the rearward end face of the frame 2 until the projections 17 on the mounting lugs **16*a* and 16B snappedly engage the apertures 18 on the sidewalls of the frame 2. Subsequently, the frame 2 is mounted on the base 1 by inserting the plate-like member 5 of the frame 2 into the recess 6 on the base 1. Thereafter, the plate-like element 12 on the frame 2 is inserted into the gap 11 on the handle 3** to complete the assembling of the stapler.

Although the present invention has been described as to a disposable stapler which can simply and easily be assembled, it is to be understood that the present invention can similarly be applied to the other types of staplers.

I claim:

1. A staple feeder for a disposable hand-held stapler of the type including an elongate tubular cartridge formed from an injection moldable material, a serially arranged collection of staples positioned within and slidable axially within said elongate tubular cartridge, and means for dispensing said staples serially from said cartridge, said elongate tubular cartridge including:

an end-closure member for said elongate tubular cartridge;

a support rod formed integrally with said end closure member and extending longitudinally within said cartridge;

a feeder element slidable on said support rod and for biasing the staples towards a dispensing position, said end closure member, said support rod and said feeder element each being formed from an injection moldable material; and a coiled compression spring surrounding said support rod and reacting between said end closure member and said feeder element for biasing said staples towards a dispensing position: the improvement comprising, lugs formed integrally with said end closure member and received within said elongate tubular cartridge, said lugs engaging inner surfaces of said elongate tubular cartridge and providing guide members for accurately positioning said end closure member and its associated support rod with respect to said elongate tubular cartridge; and oppositely directed locking members formed on said lugs and engaged within apertures formed in said elongate tubular cartridge to prevent removal of said end closure member and its associated support rod and feeder element from within said elongate tubular cartridge.

* * * * *